US005291671A

United States Patent [19]

Caberlotto et al.

[11] Patent Number: 5,291,671

[45] Date of Patent: Mar. 8, 1994

[54] FOOT SECURING DEVICE PARTICULARLY FOR TREKKING BOOTS

[75] Inventors: Alberto Caberlotto; Annamaria Furlanetto, both of Montebelluna, Italy

[73] Assignee: Arkos S.r.l., Venegazzu di Volpago del Montello, Italy

[21] Appl. No.: 847,388

[22] Filed: Mar. 6, 1992

[30] Foreign Application Priority Data

Jun. 10, 1991 [IT] Italy ..... TV91U000022

[51] Int. Cl.[5] ..... A43B 11/00; A43B 7/18

[52] U.S. Cl. ..... 36/88; 36/50.1; 36/114; 36/89; 36/92; 36/58.6

[58] Field of Search ..... 36/58, 58.5, 88, 89, 36/92, 114, 117, 119, 50.1, 58.6, 169, 170

[56] References Cited

U.S. PATENT DOCUMENTS

| | | | |
|---|---|---|---|
| D. 205,993 | 10/1966 | Ali | 36/117 |
| 1,283,335 | 10/1918 | Shillcock | 36/170 |
| 1,560,023 | 11/1925 | Dennert | 36/170 |
| 2,749,629 | 6/1956 | Scala | 36/58.5 |
| 3,138,880 | 6/1964 | Kunzli | 36/114 |
| 3,456,366 | 7/1969 | Boeing | 36/58.5 |
| 4,245,408 | 1/1981 | Larsen et al. | 36/50.1 |
| 4,408,403 | 10/1983 | Martin | 36/117 |
| 4,592,154 | 6/1986 | Oatman | 36/50.1 |
| 4,593,483 | 6/1986 | Paris | 36/50.5 |
| 4,649,939 | 3/1987 | Curtis | 36/89 |
| 4,670,998 | 6/1987 | Pasternak | 36/114 |
| 4,802,291 | 2/1989 | Sartor | 36/119 |
| 4,811,500 | 3/1989 | Maccano | 36/119 |
| 5,117,567 | 6/1992 | Berger | 36/54 |

FOREIGN PATENT DOCUMENTS

| | | | |
|---|---|---|---|
| 848020 | 10/1939 | France | 36/50.1 |
| 24854 | of 1898 | United Kingdom | 36/170 |

*Primary Examiner*—Paul T. Sewell
*Assistant Examiner*—M. D. Patterson
*Attorney, Agent, or Firm*—Guido Modiano; Albert Josif; Daniel O'Byrne

[57] ABSTRACT

Foot securing device, particularly usable in trekking boots, including a traction element which has a first portion which embraces the upper heel and malleolar region and a second portion which is curved at the foot instep region and defines grip loops for laces. The device furthermore includes a third portion which passes below approximately the median region of the sole of the foot. The device allows, once the boot has been closed, to optimally support the foot while walking, since the foot is secured in the regions overlying the heel and the foot instep.

16 Claims, 4 Drawing Sheets

FOOT SECURING DEVICE PARTICULARLY FOR TREKKING BOOTS

BACKGROUND OF THE INVENTION

The present invention relates to a foot securing device particularly usable for trekking boots.

Trekking boots are currently usually constituted by a sole and an upper which is provided, in a forward position, with a resting tab for the foot instep region and with flaps closeable by means of adapted laces.

Such trekking boots usually have an upper whose height is such as to rise above the malleolar region in order to allow optimum securing of the user's ankle. The following characteristics are usually required of these known boots: in view of their particular use, the sole employed must have a given degree of rigidity in order to support the foot while walking on rough paths, while the upper must be rather soft so as to facilitate the articulation of the foot.

These two characteristics entail a problem in known boots: the foot can in fact move rather freely inside the upper, with consequent shifting while walking which results in lower stability for the user.

The act of tightening the laces of the boots as much as possible in order to stabilize the foot inside the upper is not sufficient, and indeed such tightening causes high tension in the front part of the boot, leading to user discomfort while walking, since the foot flexes several times when walking.

SUMMARY OF THE INVENTION

The aim of the present invention is therefore to eliminate the problems described above in known types by providing a trekking boot wherein the foot is correctly accommodated within the upper and can optimally transmit efforts while walking.

Within the scope of the above aim, an important object is to provide a device which allows the foot to adhere optimally to the upper and to the sole, maintaining optimum fit for said device.

Another important object is to provide a device which prevents the foot from sliding forward while walking downhill and from sliding backward while walking uphill.

Another important object is to provide a device which can be easily activated by the user.

Another important object is to provide a device which creates no discomfort for the user while walking.

Not least object is to provide a device which is reliable and safe, which is constituted by an extremely limited number of components, and which has modest manufacturing costs.

The above aim and objects, as well as others which will become apparent hereinafter, are achieved by a foot securing device, particularly for trekking boots, which is characterized in that it is constituted by a single traction element which has a first portion which embraces the upper heel and malleolar region, a second portion which is curved at the foot instep region so as to define grip means for laces, and a third portion which passes below approximately the median region of the sole of the foot, means being finally provided for accommodating said traction element and for displaying the degree of tension thereof.

BRIEF DESCRIPTION OF THE DRAWINGS

Further characteristics and advantages of the present invention will become apparent from the detailed description of a particular embodiment thereof, illustrated only by way of non-limitative example in the accompanying drawings, wherein.

DESCRIPTION OF THE PREFERRED EMBODIMENTS

Figure 1:
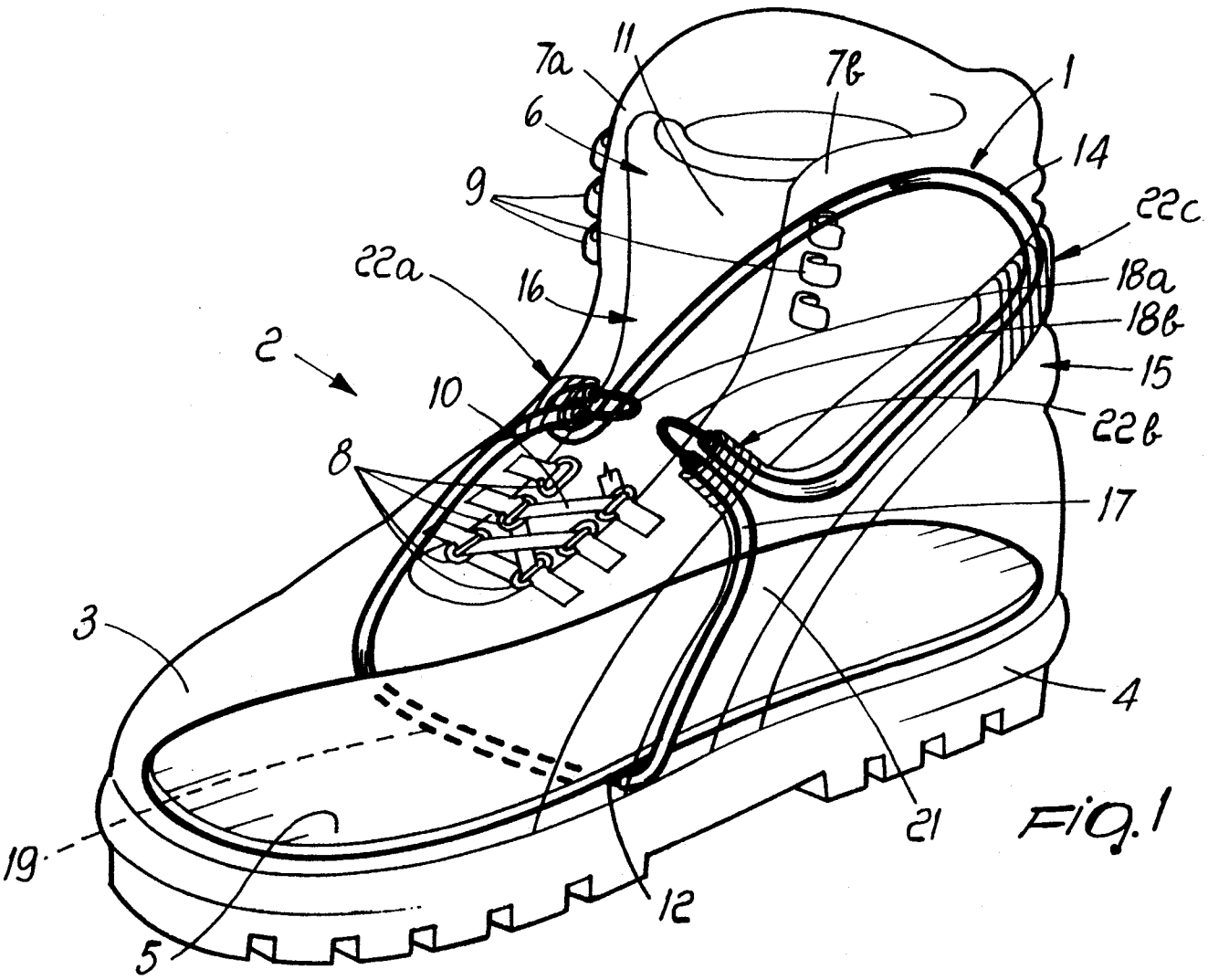
FIG. 1 is a schematic view of the device applied to a trekking boot.
Figure 2:
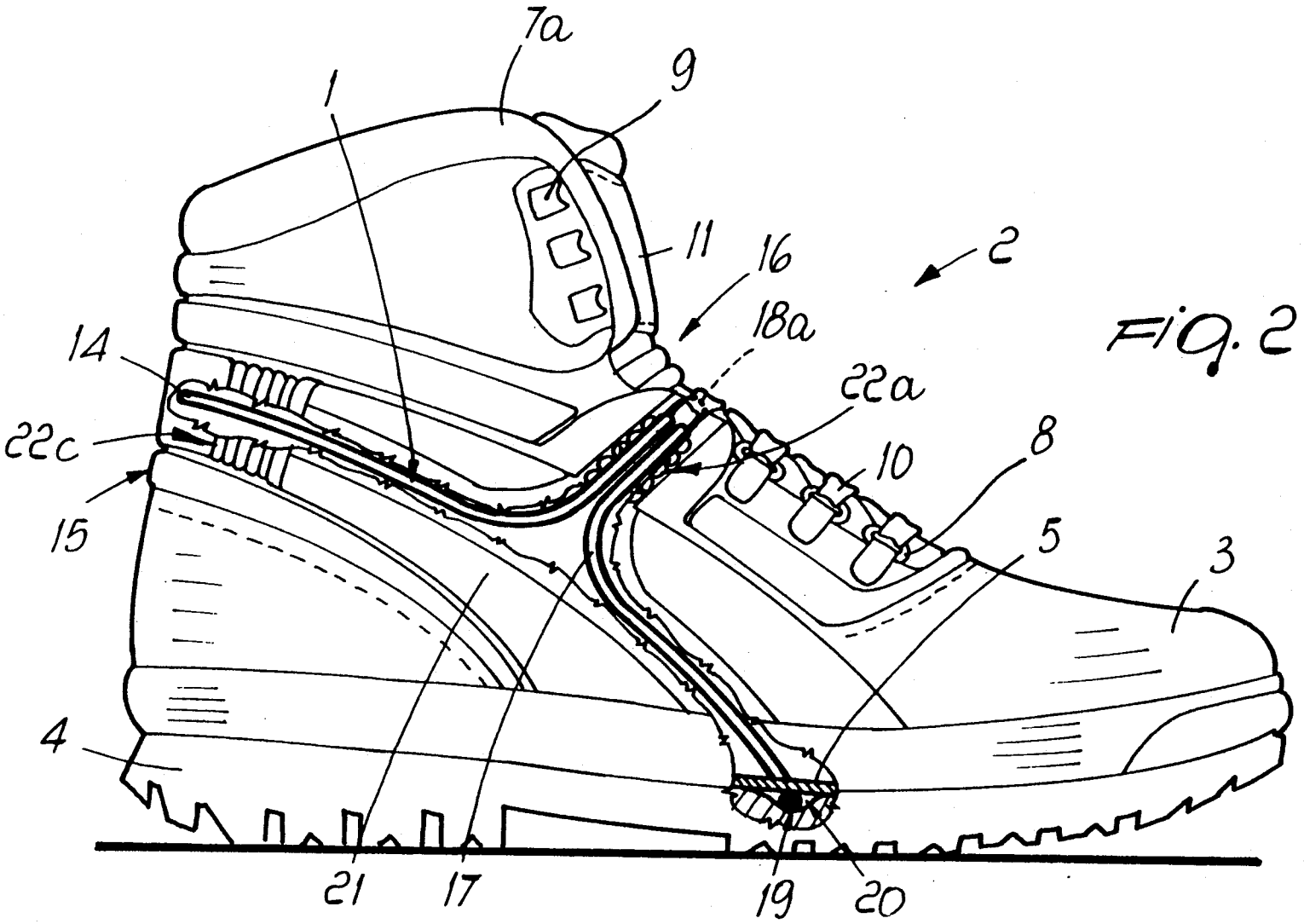
FIG. 2 is a partially sectional side view of the device and trekking boot.
Figure 4:
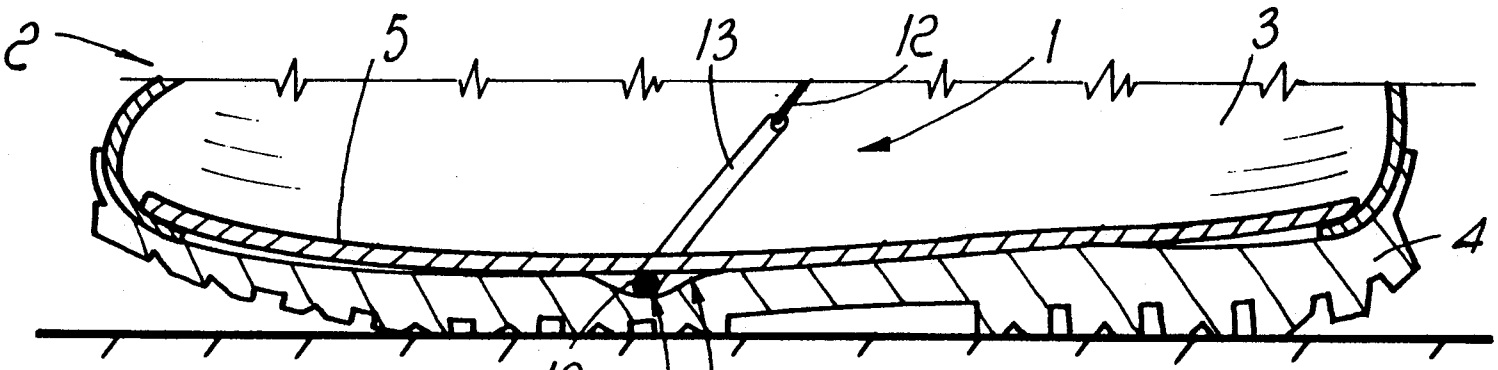
FIG. 4 is a sectional view of the device and trekking boot taken along a plane which is median and longitudinal with respect to the sole.
Figure 3:
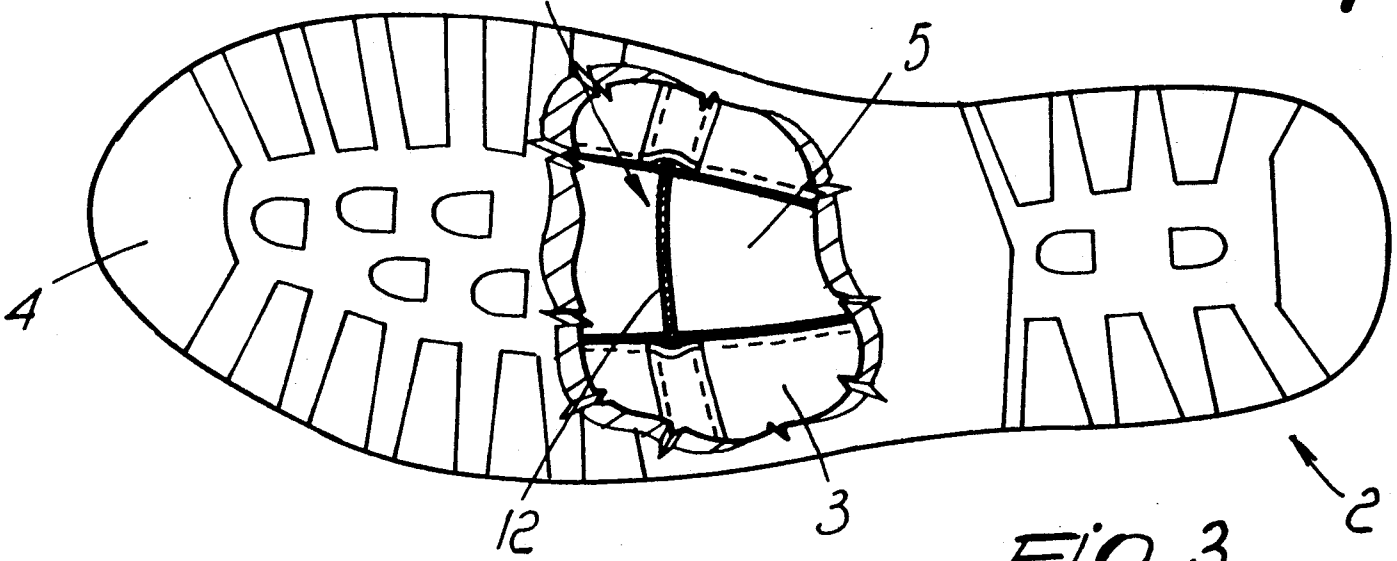
FIG. 3 is a bottom view of the device and trekking boot, with a cutout taken at the sole in order to show the passage of the cable.

With reference to the above figures, the securing device, generally designated by the reference numeral 1, can be used for a trekking boot 2.

Said boot 2 comprises an upper 3 which is associated with a sole 4; a semirigid insole 5 is interposed between said upper and said sole and has a given flexibility at the metatarsal region.

Said upper 3 is frontally provided with an opening 6 which defines a pair of flaps **7*a* and 7*b* on whose edges there are grip means, such as a plurality of rings 8 or curved hooks 9, for laces 10**.

A tongue 11 is arranged at said opening 6 so as to conceal it and is rigidly associated, at one end, with the front part of said upper 3.

The securing device 1 is constituted by a single i.e. continuous traction element, such as a cable 12 which is slidingly accommodated inside a protective sheath 13. It is evident therefore that the traction element is flexible.

Said cable 12 has a first U-shaped portion 14 which traverses the region 15 arranged above the heel and the malleoli, approximately up to the lateral foot instep region 16.

The first portion 14 is followed by a second portion 17 which is arranged transversely to the foot instep region 16 and in which the cable 12 is curved so as to define, laterally to the upper and proximate to the edges of the opening 6, grip means for the laces 10, such as a pair of loops **18*a* and 18*b*** which can thus be accessed by the user.

The second portion 17 is followed by a third portion 19 which, starting from the foot instep region 16, moves the cable 12 so that it arranges itself transversely to the upper 3 between the sole 4 and the semirigid insole 5; said cable may not be contained in the sheath at the sole and may be fixed to the sole itself.

In other words, as clearly visible from the drawing the cable 12 is a single continuous cable having a first cable portion 14 having a U-like formation extending around the upper heel region 15 and therefrom in the longitudinal direction of the boot at opposite sides thereof up to the instep region 16. The cable 12 has further second cable portions 17 extending from the first cable portion 14 at opposite sides of the instep region 16, the second cable portions 17 including opposite loop like formations **18*a* and 18*b* extending in the upwards direction of the boot at opposite sides of the instep region 16 near the opening 6 thereof, the opposite loop-like portions 18***a*, 18*b* being arranged near the opening 6 at a distance from each other thereby to define grip means for laces 10. The cable 12 has further a third cable portion 19 joining the second opposite cable portions 17 and having a section extending along the transverse extent of the boot between the sole 4 and the insole 5 at the median region thereof thereby to embrace the upper heel and upper malleolara region 15, the instep region 16 and the insole 5 at the median region.

Said sole 4 advantageously has, at the passage of the cable 12, a cavity 20 for containing the sheath 13.

The device furthermore comprises means for accommodating the cable 12 and the sheath 13 which are constituted by at least one adapted band 21 which is sewn to the upper 3 so as to define a seat for the containment and/or sliding of the cable and/or sheath.

Said band 21 thus traverses the region 15 above the heel, then is joined laterally to the upper 3 at the sole 4 and is partially arranged at the foot instep region 16.

Means for displaying the degree of tension of the cable, such as bellows 22*a*, 22*b* and 22*c* arranged at said first portion 14 and said second portion 17 except for the loops, are furthermore provided.

As clearly visible from the drawing the extension of the cable 12 around the boot is of symmetrical nature with respect to the longitudinal extent of the boot and the cable is endless.

The use of the device is as follows: once the foot has been inserted in the upper, the user applies tension to the laces 10, which allow to close the upper 3 and, at the same time, to secure the foot, since tension is also applied to the cable which interacts with the laces 10 by virtue of the presence of the loops 18*a* and 18*b* which protrude from the respective bands 21.

It has thus been observed that the device has achieved the above mentioned aim and objects, a securing device having been obtained which allows to optimally support the foot while walking, since said foot is secured in the regions overlying the heel and the foot instep.

Figure 5:
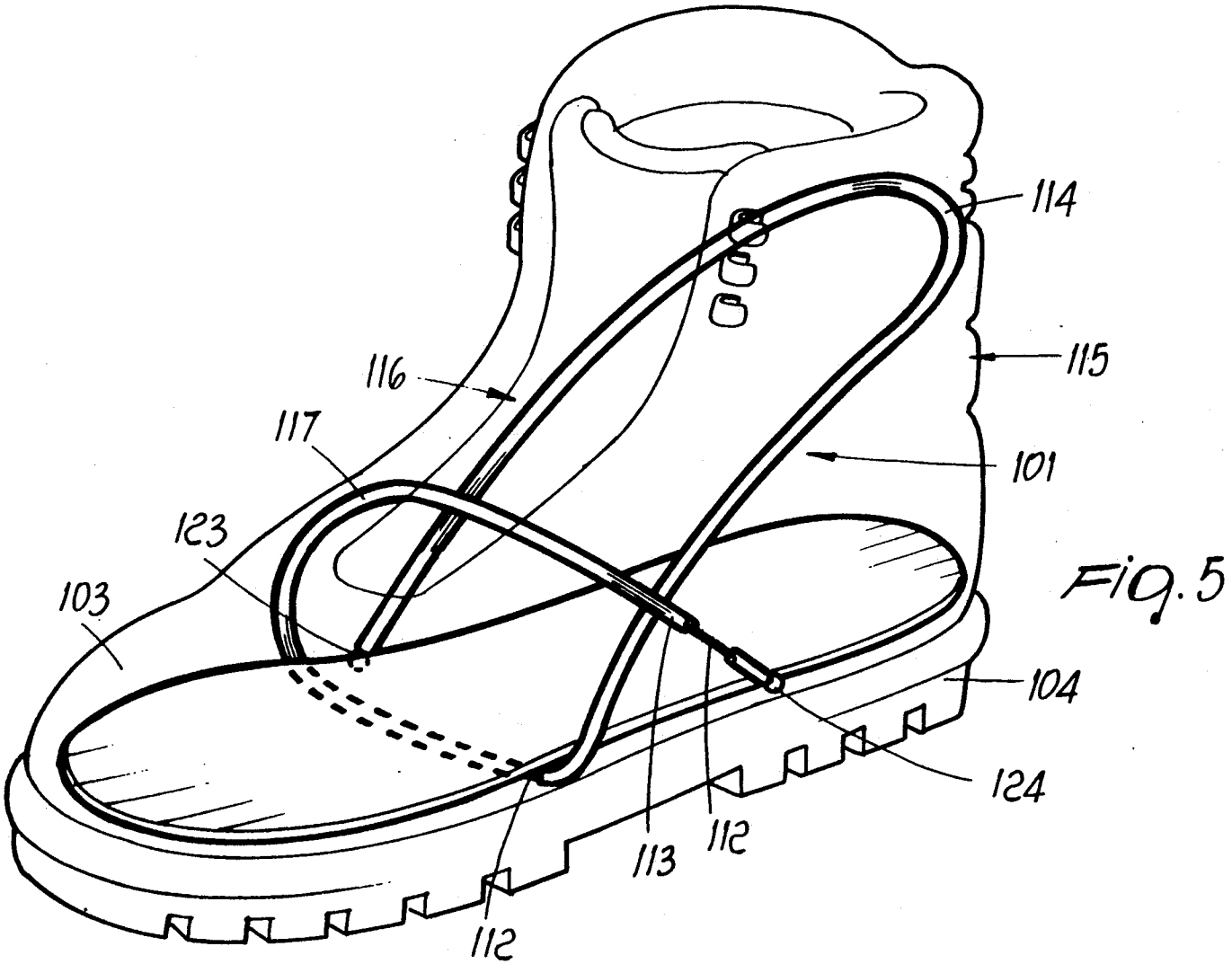
FIG. 5 is a view, similar to that of FIG. 1, of a variated passage for the cable.

FIG. 5 is a perspective view of a further embodiment of the securing device 101.

Said device is again constituted by a single cable 112 which is contained in a protective sheath 113.

Said cable 112 has a first end 123 which is rigidly associated with the sheath 113 and/or with the sole 104.

Said cable 112 then has a first portion 114 which wraps around the upper heel and malleolar region 115 and then passes approximately at the medial region of the sole of the foot, in the interspace between said sole 104 and a semirigid insole.

Said cable 112 then has a second portion 117 which is arranged transversely to the foot instep region 116; the cable is subsequently rigidly associated, at its second end 124, with the upper 103 and/or with the sole 104, on the side opposite to said first end 123.

Means for adjusting the degree of tension of said cable may be present which could be substantially of the kind shown in the first embodiment in FIG 1.

The materials and dimensions of the individual elements which constitute the securing device may naturally be the most appropriate according to the specific requirements.

We claim:

1. Foot securing device for trekking boots having an upper associated with a sole, wherein the upper includes an instep region, an upper heel region and an upper malleolar region and wherein said sole includes a median region thereof, said device comprising: a single traction element being partially slidingly accommodated in a protective sheath; and means for accommodating said protective sheath forming a seat for slidingly containing said protective sheath and said traction element accommodated therein, said means for accommodating said sheath being fixed to said upper; wherein said traction element has a first portion which embraces said upper heel region and said upper malleolar region, a second portion which is curved at said instep region so as to define grip means for laces, and a third portion so as to define grip means for laces, and third portion which passes below approximately said median region of said sole.

2. Device according to claim 1, further comprising means for displaying the degree of tension of said traction element.

3. Device according to claim 1, wherein said traction element is constituted by a cable which is partially slidingly accommodated within said protective sheath.

4. Device according to claim 1, wherein said first portion which embraces said upper heel region and said upper malleolar region extends up to said instep region.

5. Device according to claim 1, wherein said second portion is arranged transversely to said instep region in which said traction element is curved so as to define grip means for laces, said grip means being arranged laterally and proximate to an opening provided in the frontal region of said upper.

6. Device according to claim 1, wherein said third portion is starting from said instep region, and is arranged transversely to said upper between said sole and a semirigid insole interposed between said upper and said sole, said sheath being omitted at said third portion.

7. Device according to claim 6, wherein said third portion arranged transversely to said upper is contained in a cavity of said sole.

8. Device according to claim 1, wherein said means for slidingly accommodating said protective sheath is constituted by at least one adapted band which is sewn to said upper and defines a seat for containing and slidingly accommodating said traction element and said sheath, said band traversing said upper heel region and then being joined laterally to said upper at said sole of the trekking boot and being partially arranged at said instep region.

9. Device according to claim 2, wherein said means for displaying the degree of tension of said cable comprise bellows arranged at said first and second portions except for said loops.

10. A trekking boot defining a longitudinal direction thereof, a transverse direction thereof and an upwards direction thereof and comprising a sole and an upper, wherein the upper includes an instep region with a longitudinally extending opening, an upper heel region and an upper malleolar region and wherein said sole includes a median region thereof, a foot securing flexible traction element, means for slidingly accommodating at least a portion of said traction element therein, said means being secured to said upper, and wherein said traction element is a single continuous traction element having:

a first traction portion having a U-like formation extending around said upper heel region and therefrom in the longitudinal direction of said boot at opposite sides thereof up to said instep region and second traction portions extending from said first traction portion at opposite sides of said instep region, said second traction portions including opposite loop-like formations extending in said upwards direction of the boot at opposite sides of said instep region near said opening thereof, said opposite loop-like formations being arranged near said opening at a distance from each other thereby to define grip means for laces and a third traction portion joining said second opposite traction portions and having a section extending along said transverse extent of said boot at said median region of said sole thereby to embrace said upper heel region, said upper malleolar region and said instep region.

11. A trekking boot according to claim 10, wherein said loop formations at least partially protruding outside from said means for accommodating said traction element.

12. A trekking boot according to claim 10, wherein said traction element is in the form of a cable and sheath traction structure and wherein said means for accommodating said traction element are in the form of a band secured to said upper to define therebetween a seat for said cable and sheath traction structure.

13. A trekking boot according to claim 10, wherein said traction element is in the form of a cable and sheath traction structure and wherein said cable and sheath traction structure extends substantially symmetrically with respect to the longitudinal extent of the boot and wherein said cable is endless.

14. A trekking boot according to claim 10, wherein said boot further comprises an insole arranged above said sole and wherein at said median region of said sole said traction element extending transverse thereto passes between said sole and said insole.

15. A trekking boot defining a longitudinal direction thereof, a transverse direction thereof and an upwards direction thereof and comprising a sole with an insole and an upper, wherein the upper includes an instep region with a longitudinally extending opening, an upper heel region and an upper malleolar region and said sole includes a median region thereof, a foot securing traction cable, a sheath for slidingly containing at least a portion of said traction cable therein thereby to form a cable and sheath traction structure, at least one adapted band secured to said upper and defining therebetween a seat for at least a portion of said cable and sheath traction structure, and wherein said cable of said cable and sheath traction structure is a single continuous cable having:

a first cable portion having a U-like formation extending around said upper heel region and therefrom in the longitudinal direction of said boot at opposite sides thereof up to said instep region and second cable portions extending from said first cable portion at opposite sides of said instep region, said second cable portions including opposite loop-like formations extending in said upwards direction of the boot at opposite sides of said instep region near said opening thereof, said opposite loop-like portions being arranged near said opening at a distance from each other thereby to define grip means for laces and a third cable portion joining said second opposite cable portions and having a section extending along said transverse extent of said boot between said sole and said insole at said median region thereof thereby to embrace said upper heel region, said upper malleolar region, said instep region and said insole at said median region.

16. A boot according to claim 15, wherein said cable and sheath traction structure extends substantially symmetrically over said boot with respect to the longitudinal extent thereof and wherein said cable is endless.

* * * * *